United States Patent [19]

Cowles

[11] Patent Number: 4,637,366

[45] Date of Patent: Jan. 20, 1987

[54] FUEL INJECTION APPARATUS AND SYSTEM

[75] Inventor: Warren H. Cowles, Farmington Hills, Mich.

[73] Assignee: Colt Industries Operating Corp., New York, N.Y.

[21] Appl. No.: 762,387

[22] Filed: Aug. 5, 1985

[51] Int. Cl.[4] ..... F02M 25/06

[52] U.S. Cl. ..... 123/568; 123/440

[58] Field of Search ..... 123/440, 438, 568, 571

[56] References Cited

U.S. PATENT DOCUMENTS

| | | | |
|---|---|---|---|
| 3,944,634 | 3/1976 | Gerlach | 123/568 X |
| 4,292,945 | 10/1981 | Kiesling | 123/440 X |
| 4,437,447 | 3/1984 | Johnson | 123/568 |
| 4,445,485 | 5/1984 | Chamness, Jr. | 123/568 X |
| 4,509,483 | 4/1985 | Johnson | 123/440 X |
| 4,546,752 | 10/1985 | Blaser et al. | 123/568 |

*Primary Examiner*—Willis R. Wolfe, Jr.

*Attorney, Agent, or Firm*—Walter Potoroka, Sr.

[57] ABSTRACT

A fuel metering apparatus is shown as having a throttle body with an induction passage therethrough and a throttle valve for controlling flow through the induction passage, a fuel-air mixture discharge member is situated generally in the induction passage downstream of the throttle valve, an air passage communicates between a source of air and the fuel-air mixture discharge member, the air passage is shown as also including a flow restrictor therein which provides for sonic flow therethrough, and a fuel metering valving assembly having a valve member is effective for metering liquid fuel as at a superatmospheric pressure and delivering such metered liquid fuel as into the air passage upstream of the flow restrictor thereby causing the thusly metered liquid fuel and air to pass through the sonic flow restrictor before being discharged into the induction passage by the fuel-air mixture discharge member, and a portion of the exhaust gases from an associated engine is directed as to mix with the air flowing through the air passage at an area upstream of the flow restrictor.

21 Claims, 2 Drawing Figures

FUEL INJECTION APPARATUS AND SYSTEM

FIELD OF INVENTION

This invention relates generally to fuel injection systems and more particularly to fuel injection systems and apparatus for metering fuel flow to an associated combustion engine.

BACKGROUND OF THE INVENTION

Even though the automotive industry has over the years, if for no other reason than seeking competitive advantages, continually exerted efforts to increase the fuel economy of automotive engines, the gains continually realized thereby have been deemed by various levels of governing or regulatory bodies as being insufficient. Further, such levels of governing or regulatory bodies have also arbitrarily imposed regulations specifying the maximum permissible amounts of carbon monoxide (CO), hydrocarbons (HC) and oxides of nitrogen ($NO_x$) which may be emitted by the engine exhaust gases into the atmosphere.

Unfortunately, generally, the available technology employable in attempting to attain increases in engine fuel economy is contrary to that technology employable in attempting to meet legally imposed standards on exhaust emissions.

For example, the prior art in trying to meet the standards for $NO_x$ emissions has employed a system of exhaust gas recirculation whereby at least a portion of the exhaust gas is reintroduced into the cylinder combustion chamber to thereby lower the combustion temperature therein and consequently reduce the formation of $NO_x$.

The prior art has also proposed the use of engine crankcase recirculation means whereby the vapors which might otherwise become vented to the atmosphere are introduced into the engine combustion chambers for further burning.

The prior art has also proposed the use of fuel metering means which are effective for metering a relatively overly rich (in terms of fuel) fuel-air mixture to the engine combustion chamber means as to thereby reduce the creation of $NO_x$ within the combustion chamber. The use of such overly rich fuel-air mixtures results in a substantial increase in CO and HC in the engine exhaust which, in turn, requires the supplying of additional oxygen, as by an associated air pump, to such engine exhaust in order to complete the oxidation of the CO and HC prior to its delivery into the atmosphere.

The prior art has also heretofore proposed employing the retarding of the engine ignition timing as a further means for reducing the creation of $NO_x$. Also, lower engine compression ratios have been employed in order to lower the resulting combustion temperature within the engine combustion chamber and thereby reduce the creation of $NO_x$.

The prior art has also proposed the use of various forms of fuel metering injection means for eliminating the usually employed carbureting apparatus and, under superatmospheric pressure, injecting the fuel through individual nozzles directly into the respective cylinders of a piston type internal combustion engine. Such fuel injection systems, besides being costly, have not proven to be generally successful in that the system is required to provide metered fuel flow over a very wide range of metered fuel flows. Generally, those prior art injection systems which are very accurate at one end of the required range of metered fuel flows, are relatively inaccurate at the opposite end of that same range of metered fuel flows. Also, those prior art injection systems which are made to be accurate in the mid-portion of the required range of metered fuel flows are usually relatively inaccurate at both ends of that same range. The use of feedback means for altering the metering characteristics of such prior art fuel injection systems has not solved the problem of inaccurate metering because the problem usually is intertwined within such factors as: effective aperture area of the injector nozzle; comparative movement required by the associated nozzle pintle or valving member; inertia of the nozzle valving member; and nozzle "cracking" pressure (that being the pressure at which the nozzle opens). As should be apparent, the smaller the rate of metered fuel flow desired, the greater becomes the influence of such factors thereon.

It is anticipated that the said governing bodies will be establishing even more stringent exhaust emission limits and engine fuel economy requirements.

The prior art, in view of such anticipated requirements with respect to $NO_x$, has suggested the employment of a "three-way" catalyst, in a single bed, within the stream of exhaust gases as a means of attaining such anticipated exhaust emission limits. Generally, a "three-way" catalyst is a single catalyst, or catalyst mixture, which catalyzes the oxidation of hydrocarbons and carbon monoxide and also the reduction of oxides of nitrogen. It has been discovered that a difficulty with such a "three-way" catalyst system is that if the fuel metering is too rich (in terms of fuel), the $NO_x$ will be reduced effectively but the oxidation of CO will be incomplete; if the fuel metering is too lean, the CO will be effectively oxidized but the reduction of $NO_x$ will be incomplete. Obviously, in order to make such a "three-way" catalyst system operative, it is necessary to have very accurate control over the fuel metering function of associated fuel metering supply means feeding the engine. As hereinbefore described, the prior art has suggested the use of fuel injection means, employing respective nozzles for each engine combustion chamber, with associated feedback means (responsive to selected indicia of engine operating conditions and parameters) intended to continuously alter or modify the metering characteristics of the fuel injection means. However, as also hereinbefore indicated, such fuel injection systems have not proven to be successful.

It has also heretofore been proposed to employ fuel metering means, of a carbureting type, with feedback means responsive to the presence of selected constituents comprising the engine exhaust gases. Such feedback means were employed to modify the action of a main metering rod of a main fuel metering system of a carburetor. However, tests and experience have indicated that such a prior art carburetor and such a related feedbackk means apparently will never provide the degree of accuracy required in the metering of fuel to an associated engine as to assure meeting, for example, the said anticipated exhaust emission standards.

The prior art has also proposed the use of an injection system wherein a sonic nozzle-like member or flow restrictor is employed in order to accelerate a stream of air and metered fuel in order to cause atomization of the fuel prior to discharge thereof into the engine induction system. One such prior art system is shown by U.S. Pat. No. 4,292,945 dated Oct. 6, 1981. That is, in said U.S. Pat. No. 4,292,945, conduit means 88 supplies all of the air needed to sustain idle engine operation when the throttle valve means 16 is closed. As can be seen a flow circuit is described by inlet 90 of conduit 88, conduit 88, passage means 70, passage means 82, annulus 100, orifice means 102 and engine intake manifold induction passage means 13; such provides all of the air flow to the engine 20 required for idle engine operation. The restriction means 78 is of a size as to result in the flow through passage 82 being sonic during idle engine operation. The fuel which is metered by valve member 74 and injected into passage 70 mixes with the air as the metered fuel and air flow into inlet 84 of venturi nozzle-like means 78 and become accelerated to sonic velocity. The fuel within such fuel-air mixtures becomes atomized as it undergoes acceleration to sonic velocity and subsequent expansion in portion 86 of venturi means 78. The atomized fuel-air mixture then is discharged through the discharge port means 102 into passage means 13 of engine 20.

One of the problems discovered with a system as that described by said U.S. Pat. No. 4,292,945 is that of sizing of the sonic venturi (said means 78). That is, when the said sonic venturi is sized to provide just enough air flow for the low speed engine idle condition, the venturi size becomes, at best, marginal in its ability to pass the maximum fuel flow that is required and occurs at a wide open throttle high engine speed condition. If the said venturi is sized to flow the required maximum fuel flow, it then flows an excessive amount of air at the low speed engine idle condition.

The invention as herein disclosed, described and claimed is primarily directed to the solution of the aforestated and other related and attendant problems especially as they relate to the structure and teachings of said U.S. Pat. No. 4,292,945.

SUMMARY OF THE INVENTION

According to the invention, a fuel metering apparatus for supplying metered rates of fuel flow to a combustion engine comprises body means, induction passage means formed through said body means for supplying motive fluid to said engine, throttle valve means situated in said induction passage means for varibly controlling the rate of flow of air through said induction passage means, fuel-air mixture discharge means situated for discharge into said induction passage means, air passage means communicating between a source of air and said fuel-air mixture discharge means, said air passage means comprising flow restriction means, said flow restriction means being calibrated as to provide for sonic flow therethrough at conditions of idle engine operation, fuel metering means for metering liquid fuel in response to engine demands and indicia of engine operation, said liquid fuel when metered by said fuel metering means being discharged into said air passage means at an area thereof downstream of said source of air and upstream of said flow restriction means, a source of engine exhaust gas produced by said engine, and additional passage means for flowing a portion of said engine exhaust gas from said source of engine exhaust gas to said air passage means at an area thereof downstream of said source of air and upstream of said flow restriction means.

Various general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted.

DETAILED DESCRIPTION OF THE PREFERRED EMBODIMENT

Figure 1:
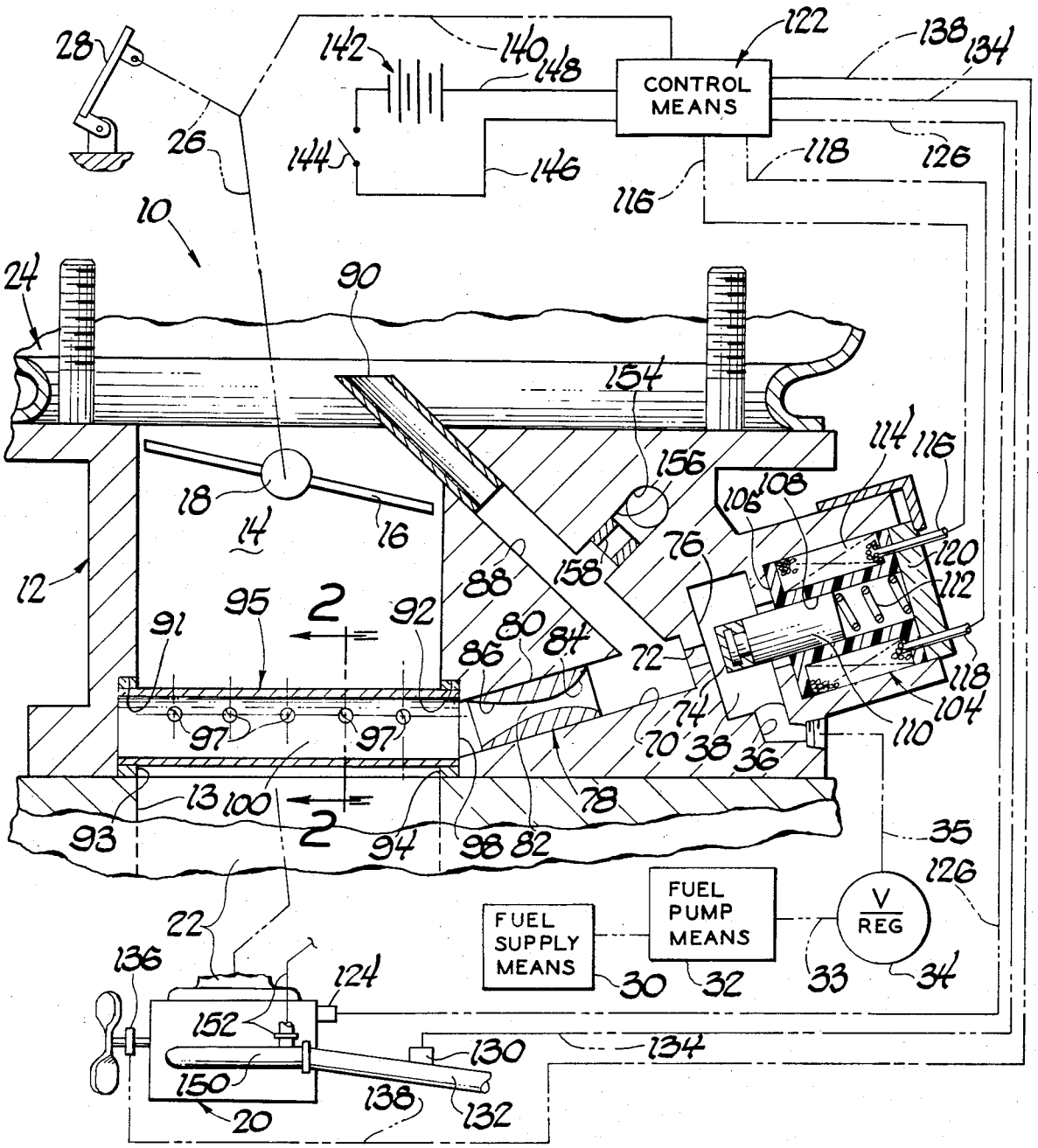
FIG. 1 illustrates, mostly in cross-section, a fuel injection apparatus and system employing teachings of the invention.
Figure 2:
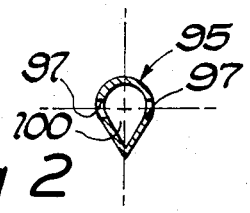
FIG. 2 is a cross-sectional view taken generally on the plane of line 2—2 of FIG. 1 and looking in the direction of the arrows.

Referring now in greater detail to the drawings, FIG. 1 illustrates fuel injection apparatus 10 and system comprised as of induction body or housing means 12 having induction passage means 14 wherein a throttle valve 16 is situated and carried as by a rotatable throttle shaft 18 for rotation therewith thereby variably restricting the flow of air through the induction passage means 14 and into the engine 20 as via associated engine intake manifold means 22. Suitable air cleaner means may be provided as to generally encompass the inlet of induction passage means 14 as generally fragmentarily depicted at 24. The throttle valve means 16 may be suitably operatively connected as through related linkage and motion transmitting means 26 to the operator positioned throttle control means which, as generally depicted, may be the operator foot-operated throttle pedal or lever 28 as usually provided in automotive vehicles.

A source of fuel as, for example, a vehicular gasoline tank 30, supplies fuel to associated fuel pumping means 32 which, in turn, delivers unmetered fuel as via conduit means 33, pressure regulator means 34 and conduit means 35 to conduit means 36 leading as to a chamber portion 38.

Generally, unmetered fuel may be provided to conduit means 36 and chamber 38 at a regulated pressure of, for example, slightly in excess of 10.0 p.s.i.

Chamber 38 is, at times, placed in communication with metered fuel passage means 70 as through a metered fuel orifice means 72. As depicted, a metering valving member 74 is adapted to at times be seated against a suitable seating surface 76 thereby terminating fuel flow from chamber 38 through passage means 72 and into passage means 70. Passage means 70 may also contain therein venturi means 78 which may take the form of an insert like member having a body 80 with a venturi passage 82 formed therethrough as to have a converging inlet or upstream surface portion 84 leading to a venturi throat from which a diffuser surface portion 86 extends downstream. A conduit 88 shown as having one end 90 communicating with a source of ambient atmosphere, as within the air cleaner assembly 24, has its other end communicating with metered fuel passage means 70 as at a point or area upstream of venturi restriction means 78 and, generally, downstream of metered fuel passage means 72.

Recesses 91 and 92 in body means 12 respectively and sealingly receive insert-like holders or adapters 93 and 94 which, in turn, sealingly support a bar-type discharge nozzle means 95 provided with a plurality of discharge apertures or ports 97 generally along both sides thereof. An open end 98 of bar nozzle 95 communicates with metered fuel passage means 70 and the downstream or outlet end of restriction means 78.

Valve member 74 is illustrated as comprising a portion of an overall oscillator type valving means or assembly 104 which, in simplified form, is depicted as comprising a spool-like bobbin 106 having inner passage means 108 slidably receiving therein an armature means 110, carrying valve member 74, and spring means 112 yieldingly urging armature 110 and valve member 74 generally toward the left and into seated engagement with valve seat means 76 terminating communication of chamber 38 with passage or conduit means 72. A field or solenoid winding or coil 114 is carried by the bobbin 106 and has its opposite electrical ends connected as to electrical conductors 116 and 118 which may pass through suitable closure means 120 and be electrically connected as to related control means 122. The practice of the invention is not limited to, for example, a particular fuel metering means; however, in the preferred embodiment, the metering valving means 104 is of the duty cycle type wherein the winding 114 is intermittently energized thereby causing, during such energization, armature 110 and valve member 74 to move in a direction away from valve orifice 72 or valve seat 76. As should be apparent, with such a duty-cycle type metering solenoid assembly the effective flow area of valve orifice or passage 72 can be variably and controllably determined by controlling the frequency and/or duration of the energization of coil means 114.

The control means 122 may comprise, for example, suitable electronic logic type control and power outlet means effective to receive one or more parameter type input signals and in response thereto produce related outputs. For example, engine temperature responsive transducer means 124 may provide a signal via transmission means 126 to control means 122 indicative of the engine temperature; sensor means 130 may sense the relative oxygen content of the engine exhaust gases (as within engine exhaust conduit means 132) and provide a signal indicative thereof via transmission means 134 to control means 122; engine speed responsive transducer means 136 may provide a signal indicative of engine speed via transmission means 138 to control means 122 while engine load, as indicated for example by throttle valve 16 position, may provide a signal as via transmission means 140 to control means 122. A source of electrical potential 142 along with related switch means 144 may be electrically connected as by conductor means 146 and 148 to control means 122.

The engine 20 is shown provided with an exhaust gas manifold means 150 to which the exhaust conduit means 132 is suitably secured. One end of a conduit means 152 is suitably connected to the exhaust gas manifold 150 as to be in communication with the interior thereof while the other end of such conduit means 152 is placed in communication with suitable inlet passage or conduit means 154 formed as in body or housing 12 and, in turn, communicating with passage or conduit means 156 leading to air passage means 88. In the preferred embodiment passage or conduit means 156 is provided with calibrated restriction means 158 even though it would, of course, be possible to have the passage 156, itself calibrated or to even employ a selectively adjustable, and subsequently fixed, restriction means instead of the depicted fixed restriction means 158.

OPERATION OF INVENTION

Generally, in the embodiment disclosed, fuel under regulated pressure is supplied as by fuel pump means 32 to conduit 36 and chamber 38 and such fuel is metered through the effective metering area of valve orifice means 72 to conduit portion 70 from where such metered fuel flows through restriction means 78 and into passage 100 of nozzle 95 and ultimately through discharge port means 97 to the engine 20. The rate of metered fuel flow, in the embodiment disclosed, will be dependent upon the relative percentage of time, during an arbitrary cycle time or elapsed time, that the valve member 74 is relatively close to or seated against orifice seat 76 as compared to the percentage of time that the valve member 74 is relatively far away from the cooperating valve seat 76.

This, in turn, is dependent on the output to coil 114 from control means 122 which, in turn, is dependent on the various parameter signals received by the control means 122. For example, if the oxygen sensor and transducer means 130 senses the need of a further fuel enrichment in the motive fluid being supplied to the engine and transmits a signal reflective thereof to the control means 122, the control means 122, in turn, will require that the metering valve 74 be opened a greater percentage of time as to provide the necessary increased rate of metered fuel flow. The practice of the invention is not limited to a particular form of fuel metering means or to a particular system for the control of such fuel metering means. Accordingly, it will be understood that given any selected parameters and/or indicia of engine operation and/or ambient conditions, the control means 122 will respond to the signals generated thereby and respond as by providing appropriate energization and de-energization of coil means 114 (causing corresponding movement of valve member 74) thereby achieving the then required metered rate of fuel flow to the engine.

Conduit means 88 supplies all of the air needed to sustain idle engine operation when the throttle valve means 16 is closed. As can be seen a flow circuit is described by inlet 90 of conduit 88, conduit 88, passage means 70, passage means 82, passage 100, orifice means 97 and engine intake manifold induction passage means 13; such provides all of the air flow to the engine 20 required for idle engine operation. The restriction means 78 is of a size as to result in the flow through passage 82 being sonic during idle engine operation. The fuel which is metered by valve member 74 and injected into passage 70 mixes with the air as the metered fuel and air flow into inlet 84 of venturi nozzle-like means 78 and become accelerated to sonic velocity. The fuel within such fuel-air mixtures becomes atomized as it undergoes acceleration to sonic velocity and subsequent expansion in portion 86 of venturi means 78. The atomized fuel-air mixture then passes into passage 100 and is discharged, through the discharge port means 97 and into passage means 13 of engine 20. In the invention, the restriction means 78 not only provides for sonic flow therethrough during idle engine operation but also provides for sonic flow therethrough during conditions of engine operation other than idle and over the entire range of engine operation as will be further described.

When further engine power is required, throttle valve means 16 is opened to an appropriate degree and the various related parameter sensing means create input signals to control means 122 resulting in fuel metering means 104 providing the corresponding increase in the rate of metered fuel to the passage 70 and, as hereinbefore described, ultimately to engine 20.

As should be apparent, suitable temperature responsive means may be provided in order to slightly open throttle valve 16 during cold engine idle operation in order to thereby assist in sustaining such cold engine idle operation and preclude rough engine operation.

As was hereinbefore stated, a problem of the prior art systems as that disclosed by said U.S. Pat. No. 4,292,945 is that of sizing of the sonic venturi or restriction. That is, when the said sonic venturi is sized to provide just enough air flow for the low speed engine idle condition, the sonic venturi size becomes, at best, marginal in its ability to flow the maximum fuel flow that is required and occurs at a wide open throttle high engine speed condition. If the said sonic venturi is sized to flow the required maximum fuel flow, it then flows an excessive amount of air at the low speed engine idle condition.

The invention as herein disclosed and described overcomes such prior art problem by actually increasing the flow size of the sonic restriction means 78 and by the introduction of a portion of the engine exhaust gas into the air flowing to the sonic restriction means 78.

More particularly, during engine operation a portion of the engine exhaust gas, which is inert, flows from exhaust manifold 150, through conduit means 152, inlet passage 154, through conduit means 156 and into air passage means 88 where it mixes with the air flowing through passage 88. Since there is some degree of superatmospheric pressure in the exhaust gas, restriction means 158 is selected as to result in a pressure drop thereacross so that the exhaust gas passing therethrough exits at substantially ambient atmospheric pressure which is the pressure of the air flowing through and supplied via conduit means 88.

The thusly mixed air and exhaust gas is then commingled with the fuel injected via injection passage 72 (as previously described) and the air-exhaust gas-fuel mixture then flows through the sonic restriction means 78 in the manner previously described. However, in the invention, with all other influencing factors being equal, the effective flow area of the sonic restriction is made larger than that of prior art so that the effective flow area of the sonic restriction is capable of flowing the required maximum fuel flow required by the engine during wide open throttle high engine speed conditions. The fact that the flow area of the flow restrictor of the invention is thusly enlarged does not result in an increase in idle air flow through the sonic venturi as would adversely effect low engine speed idle operation because the portion of the gaseous flow through the sonic venturi which represents the increase in the rate of volumetric flow is composed of the inert exhaust gas supplied via conduit means 152, 154 and 156.

Accordingly, it can be seen that by introducing an inert gas, such as engine exhaust gas, to the air flow upstream of the sonic nozzle or restriction means 78, the flow size of such means 78 can be made relatively larger and both ends of the range of required metered fuel flow to the engine can be satisfied.

In the preferred embodiment of the invention, passage means 70 immediately downstream of metered fuel passage 72 is at substantially ambient atmospheric pressure thereby enabling the pressure regulator 34 to be referenced to ambient atmospheric pressure which then, in turn, enables the fuel pump means 32 to supply fuel to chamber means 38 at a pressure resulting in a substantially constant pressure differential across passage 72.

Although only a preferred embodiment of the invention has been disclosed and described it is apparent that other embodiments and modifications of the invention are possible within the scope of the appended claims.

What is claimed is:

1. Fuel metering apparatus for supplying metered rates of fuel flow to a combustion engine, comprising body means, induction passage means formed through said body means for supplying motive fluid to said engine, throttle valve means situated in said induction passage means for variably controlling the rate of flow of air through said induction passage means, fuel-air mixture discharge means situated for discharge into said induction passage means, air passage means communicating between a source of air and said fuel-air mixture discharge means, said air passage means comprising flow restriction means, said flow restriction means being calibrated as to provide for sonic flow therethrough at conditions of idle engine operation, fuel metering means for metering liquid fuel in response to engine demands and indicia of engine operation, all of said liquid fuel when metered by said fuel metering means being discharged into air flowing through said air passage means at an area thereof downstream of said source of air and upstream of said flow restriction means as to flow through said flow restriction means, wherein said air flowing through said air passage means and said liquid fuel discharged into said air flowing through said air passage means comprises said fuel-air mixture, a source of engine exhaust gas produced by said engine, and additional calibrated flow restriction passage means for flowing a portion of said engine exhaust gas from said source of engine exhaust gas to said air passage means at an area thereof downstream of said source of air and upstream of said flow restriction means, wherein the volumetric rate of flow through said flow restriction means is such as would during idle engine operation provide for an excessive rate of flow therethrough of said air within said fuel-air mixture, and wherein said portion of said engine exhaust gas serves to prevent said excessive rate of flow of said air by displacement thereof.

2. Fuel metering apparatus according to claim 1 wherein said flow restriction means comprises venturi type restriction means.

3. Fuel metering apparatus according to claim 1 wherein said fuel metering means for metering liquid fuel comprises a duty-cycle type metering solenoid assembly, wherein said metering solenoid assembly comprises armature means, a valve member operatively carried by said armature means, and a field winding, said field winding being intermittently energizable during metering of said liquid fuel as to cause said armature means and said valve member to move toward and away from a closed position and thereby result in an average rate of flow of fuel past said valve member which constitutes the then metered rate of liquid fuel flow.

4. Fuel metering apparatus according to claim 1 and further comprising unmetered fuel passage means for supplying unmetered fuel to said fuel metering means upstream of said fuel metering means, and pressure regulator means operatively communicating with said unmetered fuel for regulating the pressure thereof to a preselected magnitude.

5. Fuel metering apparatus according to claim 1 wherein said portion of said engine exhaust gas mixes with said air flowing through said air passage means and is discharged with said fuel-air mixture by said fuel-air mixture discharge means.

6. Fuel metering apparatus according to claim 1 wherein said fuel-air mixture discharge means comprises tubular passage means in said induction passage means and extending transversely thereof, wherein said air passage means in communicating with said fuel-air mixture discharge means communicates with an open end of said tubular passage means, and discharge port means communicating between said tubular passage means and said induction passage means for directing the flow of said fuel-air mixture along with said portion of said engine exhaust gas to said induction passage means.

7. Fuel metering apparatus according to claim 6 wherein said tubular passage means comprises an upstream disposed portion and a downstream disposed portion joined by oppositely disposed side wall portions, wherein said discharge port means comprises first and second pluralities of discharge ports, wherein one of said pluralities of discharge ports are formed through one of said side wall portions, and wherein the other of said pluralities of discharge ports are formed through the other of said side wall portions.

8. Fuel metering apparatus for supplying metered rates of fuel flow to a combustion engine, comprising body means, induction passage means formed through said body means for supplying motive fluid to said engine, throttle valve means situated in said induction passage means for variably controlling the rate of flow of air through said induction passage means, fuel-air mixture discharge means situated for discharge into said induction passage means, air passage means communicating between a source of air and said fuel-air mixture discharge means, said air passage means comprising flow restriction means, said flow restriction means being calibrated as to provide for sonic flow therethrough at conditions of idle engine operation, fuel metering means for metering liquid fuel in response to engine demands and indicia of engine operation, said liquid fuel when metered by said fuel metering means being discharged into air flowing through said air passage means at an area thereof downstream of said source of air and upstream of said flow restriction means, wherein said air flowing through said air passage means and said liquid fuel discharged into said air flowing through said air passage means comprises said fuel-air mixture, a source of engine exhaust gas produced by said engine, and additional passage means for flowing a portion of said engine exhaust gas from said source of engine exhaust gas to said air passage means at an area thereof downstream of said source of air and upstream of said flow restriction means, said additonal passage means comprising calibrated passage means for causing a pressure drop in said portion of said engine exhaust gas prior to its entry into said air passage means as to result in said portion of said engine exhaust gas having a pressure substantially that of said air flowing through said air passage means as said portion of said engine exhaust gas enters said air passage means.

9. Fuel metering apparatus according to claim 8 wherein said flow restriction means comprises venturi type restriction means.

10. Fuel metering apparatus according to claim 8 wherein said fuel metering means for metering liquid fuel comprises a duty-cycle type metering solenoid assembly, wherein said metering solenoid assembly comprises armature means, a valve member operatively carried by said armature means, and a field winding, said field winding being intermittently energizable during metering of said liquid fuel as to cause said armature means and said valve member to move toward and away from a closed position and thereby result in an average rate of flow of fuel past said valve member which constitutes the then metered rate of liquid fuel flow.

11. Fuel metering apparatus according to claim 8 and further comprising unmetered fuel passage means for supplying unmetered fuel to said fuel metering means upstream of said fuel metering means, and pressure regulator means operatively communicating with said unmetered fuel for regulating the pressure thereof to a preselected magnitude.

12. Fuel metering apparatus according to claim 8 wherein said portion of said engine exhaust gas mixes with said air flowing through said air passage means and is discharged with said fuel-air mixture by said fuel-air mixture discharge means.

13. Fuel metering apparatus acording to claim 8 wherein said fuel-air mixture discharge means comprises tubular passage means in said induction passage means and extending transversely thereof, wherein said air passage means in communicating with said fuel-air mixture discharge means communicates with an open end of said tubular passage means, and discharge port means communicating between said tubular passage means and said induction passage means for directing the flow of said fuel-air mixture along with said portion of said engine exhaust gas to said induction passage means.

14. Fuel metering apparatus according to claim 13 wherein said tubular passage means comprises an upstream disposed portion and a downstream disposed portion joined by oppositely disposed side wall portion, wherein said discharge port means comprises first and second pluralities of discharge ports, wherein one of said pluralities of discharge ports are formed through one of said side wall portions, and wherein the other of said pluralities of discharge ports are formed through the other of said side wall portions.

15. Fuel metering apparatus for supplying metered rates of fuel flow to a combustion engine, comprising body means, induction passage means formed through said body means for supplying motive fluid to said engine, throttle valve means situated in said induction passage means for variably controlling the rate of flow of air through said induction passage means, fuel-air mixture discharge means situated for discharge into said induction passage means, air passage means communicating between a source of air and said fuel-air mixture discharge means, said air passage means comprising flow restriction means, said flow restriction menas being calibrated as to provide for sonic flow therethrough at conditions of idle engine operation, fuel metering means for metering liquid fuel in response to engine demands and indicia of engine operation, said liquid fuel when metered by said fuel metering means being discharged into air flowing through said air passage means at an area thereof downstream of said source of air and upstream of said flow restriction means, wherein said air flowing through said air passage means and said liquid fuel discharged into said air flowing through said air passage means comprises said fuel-air mixture, a source of engine exhaust gas produced by said engine, additional passage means for flowing a portion of said engine exhaust gas from said source of engine exhaust gas to said air passage means at an area thereof downstream of said source of air and upstream of said flow restriction means, and additional flow restriction means, said additional flow restriction means being situated in series fluid circuit with said additonal passage means.

16. Fuel metering apparatus according to claim 15 wherein the first mentioned flow restriction means comprises venturi type restriction means.

17. Fuel metering apparatus according to claim 15 wherein said fuel metering means for metering liquid fuel comprises a duty-cycle type metering solenoid assembly, wherein said metering solenoid assembly comprises armature means, a valve member operatively carried by said armature means, and a field winding, said field winding being intermittently energizable during metering of said liquid fuel as to cause said armature means and said valve member to move toward and away from a closed position and thereby result in an average rate of flow of fuel past said valve member which constitutes the then metered rate of liquid fuel flow.

18. Fuel metering apparatus according to claim 15 and further comprising unmetered fuel passage means for supplying unmetered fuel to said fuel metering means upstream of said fuel metering means, and pressure regulator means operatively communicating with said unmetered fuel for regulating the pressure thereof to a preselected magnitude.

19. Fuel metering apparatus according to claim 15 wherein said portion of said engine exhaust gas mixes with said air flowing through said air passage means and is discharged with said fuel-air mixture by said fuel-air mixture discharge means.

20. Fuel metering apparatus according to claim 15 wherein said fuel-air mixture discharge means comprises tubular passage means in said induction passage means and extending transversely thereof, wherein said air passage means in communicating with said fuel-air mixture discharge means communicates with an open end of said tubular passage means, and discharge port means communicating between said tubular passage means and said induction passage means for directing the flow of said fuel-air mixture along with said portion of said engine exhaust gas to said induction passage means.

21. Fuel metering apparatus according to claim 20 wherein said tubular passage means comprises an upstream disposed portion and a downstream disposed portion joined by oppositely disposed side wall portions, wherein said discharge port means comprises first and second pluralities of discharge ports, wherein one of said pluralities of discharge ports are formed through one of said side wall portions, and wherein the other of said pluralities of discharge ports are formed through the other of said side wall portions.

* * * * *